US005205138A

United States Patent [19]

Besore et al.

[11] Patent Number: 5,205,138

[45] Date of Patent: Apr. 27, 1993

[54] SPINE FIN REFRIGERATOR EVAPORATOR

[75] Inventors: John K. Besore; Bruce L. Ruark, both of Louisville, Ky.; Jerry C. Martin, Corydon, Ind.

[73] Assignee: General Electric Company, Louisville, Ky.

[21] Appl. No.: 818,137

[22] Filed: Jan. 8, 1992

[51] Int. Cl.[5] ..... F25B 39/02

[52] U.S. Cl. ..... 62/515; 165/146; 165/903

[58] Field of Search ..... 62/515; 165/146, 903

[56] References Cited

U.S. PATENT DOCUMENTS 4,040,268 8/1977 Howard ..... 62/335
4,441,546 4/1984 VanderVaart ..... 62/276
5,067,322 11/1991 Beers ..... 62/515

*Primary Examiner*—Ronald C. Capossela

*Attorney, Agent, or Firm*—Radford M. Reams; H. Neil Houser

[57] ABSTRACT

A spine fin refrigerator evaporator is formed of lower and upper sections of elongated straight runs, which have fins thereon and have their ends connected to each other by return bent ends. The lower section is formed with two rows of the elongated straight runs in an A shape to provide a passage therebetween through which air initially flows through the evaporator so that frost can be gathered without blocking air flow therethrough. The upper section has three rows of the elongated straight runs with the fins of adjacent rows overlapping each other to provide an efficient heat transfer from the refrigerant in the elongated straight runs to the air whereby the lower and upper sections combine to provide a practical and efficient evaporator. If desired, the upper and lower sections can be vertically spaced from each other to have a defrost heater disposed therebetween.

15 Claims, 3 Drawing Sheets

SPINE FIN REFRIGERATOR EVAPORATOR

FIELD OF THE INVENTION

This invention relates to a spine fin refrigerator evaporator and, more particularly, to a spine fin refrigerator evaporator having a first section with elongated straight runs, which have their ends connected to each other by return bent ends, spaced from each other so that fins on the elongated straight runs do not overlap and a second section, which is connected to the first section, with fins on the elongated straight runs, which have their ends connected by return bent ends, spaced from each other so that the fins on the elongated straight runs overlap.

BACKGROUND OF THE INVENTION

U.S. Pat. No. 5,067,322 issued to David G. Beers on Nov. 26, 1991, for "Refrigerator With Spine Fin Evaporator", and assigned to the same assignee as the assignee of this application, discloses a spine fin evaporator for a refrigerator. The spine fins of the evaporator of the aforesaid Beers patent, which is incorporated by reference herein, provide a large heat exchange area per unit length of the evaporator conduit or tube. This increase in the heat exchange area per unit length of the evaporator conduit or tube enables the size of the evaporator to be reduced to increase the usable storage space of the refrigerator.

The air being refrigerated by the evaporator is laden with moisture, and the evaporator normally operates at frost collecting temperatures. The moisture laden air flows around the fins and frost tends to build up quickly at the inlet end of the spine fin evaporator. This build up of frost requires the evaporator to be defrosted fairly often so that the overall operating efficiency of the refrigerator is reduced.

The spine fin evaporator of the present invention satisfactorily solves the frost build up problem through forming the evaporator in first and second sections of contrasting shapes when viewed from the end of the evaporator. Each of the first and second sections is formed of elongated straight runs, which have fins thereon and have their ends connected by return bent ends. The elongated straight runs of the first section, which has air flow over it initially, are arranged in two rows spaced sufficiently from each other to allow frost build up without air blockage and to enhance the ease of defrosting; the fins of the first section do not overlap.

The second section has a plurality of rows of the elongated straight runs with their fins overlapping. The overlapping of the fins provides a highly efficient heat exchange relation between the refrigerant in the evaporator and the air flowing thereover.

The close packing of the elongated straight runs of the second section of the evaporator provides a relatively large surface area of the evaporator for each cubic foot of space. This permits more usable space in the refrigerator.

The close spacing of the second section, with its overlapping fins, makes this section relatively intolerant of frost build-up; that is, frost build-up on the section will more quickly close the various passage between the fins and will cause the air to flow around the outside of the evaporator. Also, effective defrosting of the second section is more difficult as the close spacing of the fins means the frost must essentially comletely melt in order to fall off.

The two sections work in concert to provide a highly effective evaporator.

The first section collects relatively large amounts of frost build up which, because of the size of the spacing between the two rows of the evaporator, it can easily accommodate. Since the first section removes most of the moisture from the air, the first section aids in preventing any significant amount of frost from gathering on the closely packed second section so as to reduce the amount of frost to be removed therefrom.

SUMMARY OF THE INVENTION

A refrigerant evaporator, which is disposed within an evaporator chamber of a refrigerator through which air is caused to flow, is formed by an elongated tube having elongated straight runs joined by return bent ends with at least each of the elongated straight runs having heat exchange fins therealong projecting outwardly therefrom. The elongated straight runs are arranged in the evaporator chamber in a plurality of passes extending substantially perpendicular to the direction of air flow through the evaporator chamber.

Some of the elongated straight runs form a first section, which is initially exposed to the air flowing through the evaporator chamber, having its elongated straight runs arranged in two rows substantially perpendicular to the direction of air flow with the fins in the two rows spaced from each other to form an air passage therebetween. Other of the elongated straight runs form a second section connected to the first section. The elongated straight runs of the second section are exposed to air flow after the air has passed through the first section and are arranged in a plurality of rows substantially perpendicular to the direction of air flow through the evaporator chamber. The elongated straight runs of the second section have their fins in each row overlapping the fins in each adjacent row.

An object of this invention is to provide an improved spine fin evaporator which has excellent frost tolerance and heat exchange capabilities.

Another object of this invention is to provide a spine fin evaporator having a first section, which has air flow over it initially, with relatively unobstructed air flow and a second section with relatively restricted air flow.

A further object of this invention is to provide a relatively efficient spine fin refrigerator.

Other objects of this invention will be readily perceived from the following description, claims, and drawings.

BRIEF DESCRIPTION OF THE DRAWINGS

The attached drawings illustrate preferred embodiments of the invention, in which.

DESCRIPTION OF THE PREFERRED EMBODIMENTS

Figure 1:
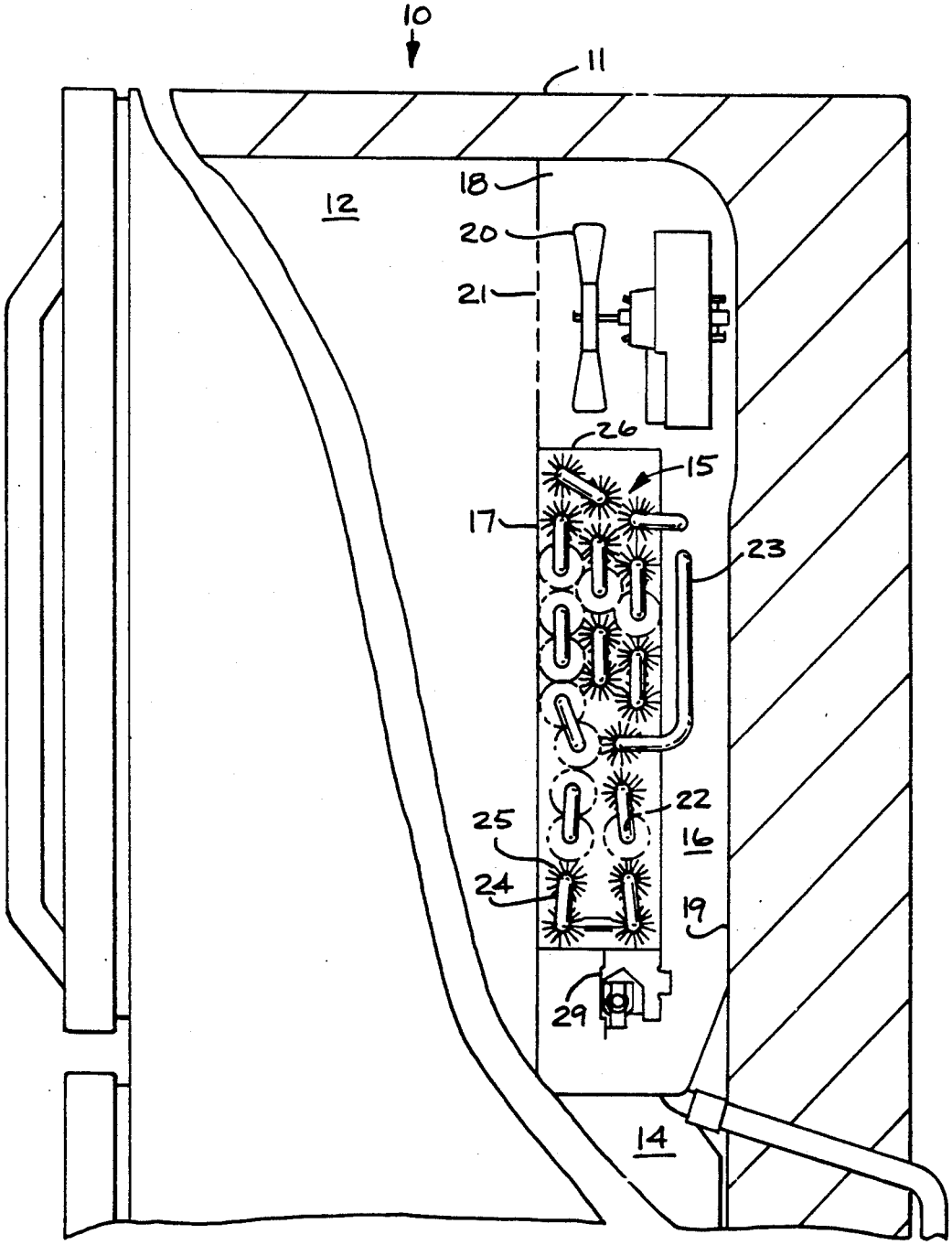
FIG. 1 a side elevational view, partly in section, of a refrigerator having a freezer compartment above a fresh food compartment and including a spine fin evaporator incorporating one embodiment of the present invention.

Referring to the drawings and particularly FIG. 1, there is shown a refrigerator 10 including an outer cabinet 11 containing a freezer compartment 12 and a fresh food compartment 14 with the freezer compartment 12 disposed vertically above the fresh food compartment 14. The freezer compartment 12 is maintained at below freezing temperatures and the fresh food compartment 14 is maintained at above freezing-food preserving temperatures by circulating air over a spine fin evaporator 15.

The evaporator 15 is disposed within a vertically extending evaporator chamber 16. The evaporator chamber 16 is formed by a vertically extending front wall 17, vertically extending substantially parallel side walls (one shown at 18), and an inner rear liner 19 of the refrigerator 10.

A motor driven fan 20 is positioned in the upper portion of the evaporator chamber 16 and discharges cooling air through openings 21 in the front wall 17 of the evaporator chamber 16 into the freezer compartment 12. Some of the air flows from the freezer compartment 12 through a passage (not shown) into the fresh food compartment 14 in a manner well known in the art.

The cooling air supplied from the fan 20 (see FIG. 1) through the openings 21 is divided so that the freezer compartment 12 is maintained at below freezing temperatures and the fresh food compartment 14 is maintained at above freezing but food preserving temperatures. This division of the cooling air is well known in the art.

Figure 3:
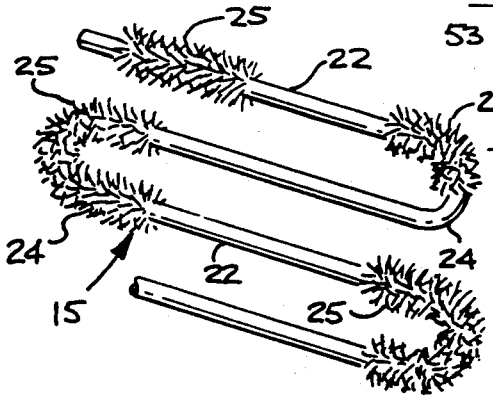
FIG. 3 is a perspective view of a portion of the spine fin evaporator of the present invention showing two elongated straight runs having return bent ends.

The fan 20 also draws air from the freezer compartment 12 and the fresh food compartment 14 into the lower portion of the evaporator chamber 16. Thus, the return air flows upwardly over the evaporator 15 from its lower end and flows substantially perpendicular to elongated straight runs 22 (see FIG. 3) of the evaporator 15.

The serpentine evaporator 15 has refrigerant supplied from a condenser (not shown) and an expansion device (not shown) as is well known in the art through an inlet tube 23 (see FIG. 1) connected to one end of one of the series elongated straight runs 22. From the elongated straight run 22 connected to the inlet tube 23, the refrigerant flows serially through the elongated straight runs 22 to the elongated straight run 22 connected to an outlet tube 23' through which refrigerant flows from the evaporator 15 to a compressor (not shown) as is well known in the art. To this end, the elongated runs 22 are connected in series for flow of refrigerant through the evaporator, with the outlet of each straight run 22 connected to the inlet of the next straight run 22 by a return bent end 24. The elongated straight runs 22 and the return bent ends 24 form the evaporator 15 which is an elongated tube having a serpentine arrangement. Each of the elongated straight runs 22 and each of the return bent ends 24 has spine fins 25 extending substantially perpendicular therefrom. The fins 25 are formed in a ribbon of material which is wrapped around each of the elongated straight runs 22 and each of the return bent ends 24 in the manner shown and described in the aforesaid Beers patent.

The evaporator 15 is supported within the evaporator chamber 16 by each of the return bent ends 24 being retained within a corresponding positioning and retaining opening in one of a pair of substantially parallel end channels 26 (one shown). Each of the end channels 26 may be formed by galvanized steel or aluminum. The end channels 26 may have mounting holes (not shown) therein for mounting to the freezer liner of the refrigerator 10. The liner may have special receptacles or supports to allow for attachment.

Figure 2:
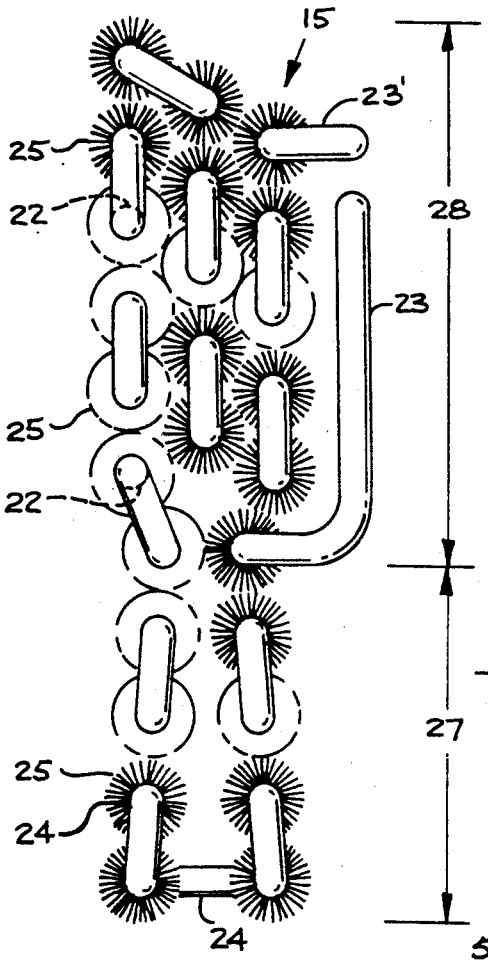
FIG. 2 is an enlarged end elevational view of the evaporator of FIG. 1.

As shown in FIG. 2, the evaporator 15 has a lower or first section 27 formed by two rows of the elongated straight runs 22 in which each of the elongated straight runs 22 of the two rows extends substantially perpendicular to the direction of flow of air through the evaporator 15. The first section 27 of elongated straight runs 22 is deemed to terminate when the fins 25 on one of the elongated straight runs 22 in each of the two rows overlap.

The two rows of the elongated straight runs 22 of the first section 27 define a vertically extending passage therebetween. The passage is relatively wide at its bottom end, at which the air initially enters, and decreases in width toward its top. Thus, the larger space between the two rows of the elongated straight runs 22 in the first section 27 forms an "A" or "inverted V" shape when viewed from the side of the evaporator 15.

Because the evaporator 15 operates at below freezing temperatures to maintain the appropriate temperatures in the freezer compartment 12 (see FIG. 1) and the fresh food compartment 14, the moisture in the air returning from the freezer compartment 12 and the fresh food compartment 14 condenses on the evaporator 15 in the form of frost. Since the entrance to the first section 27 (see FIG. 2) of the elongated straight runs 22 is where the moisture laden air initially condenses on the evaporator 15 in the form of frost, this is where maximum spacing is desired. That is, as the moisture is removed from the air during flow of the air upwardly through the evaporator 15 by condensation on the lower of the elongated straight runs 22 of the first section 27, less moisture is available for condensing on the remainder of the evaporator 15 in the form of frost.

Therefore, when the air reaches the end or top of the first section 27 of the elongated straight runs 22 of the evaporator 15, a relatively large portion of the total moisture in the air has condensed on the elongated straight runs 22 and the return bent ends 24 of the first section 27 of the evaporator 15. Therefore, a relative small amount of moisture remains to be gathered above the first section 27 of the elongated straight runs 22.

As shown in FIG. 2, a second or upper section 28 of the elongated straight runs 22 extends from the top or end of the first or lower section 27 to the uppermost end of the evaporator 15. The second section 28 has the elongated straight runs 22 closely or tightly packed in a plurality of vertically extending rows, with three rows being shown. The number of the rows of the elongated straight runs 22 would depend on the size of the evaporator chamber 16 (see FIG. 1).

Each of the rows of the second section 28 (see FIG. 2) have the elongated straight runs 22 not only substantially perpendicular to the flow of air through the evaporator chamber 16 (see FIG. 1) but also substantially parallel to each other. Each of the rows of elongated straight runs 22 (see FIG. 1) has the fins 25 thereon overlapping the fins 25 on each adjacent row of the elongated straight runs 22. Thus, with the second or upper section 28 having three rows of the elongated straight runs 22, the middle row has the fins 25 thereon overlapping the fins 25 on each of the adjacent rows while each of the two outer rows has only the fins 25 on the elongated straight runs 22 of the middle row in overlapping relation. In addition, the fins 25 of the adjacent elongated runs 22 in each vertical row may overlap.

This overlapping relation of the fins 25 substantially reduces the amount of air flowing over any one of the elongated straight runs 22 since it limits the available air flow area of each path through the second or upper section 28. Furthermore, as previously mentioned, a substantially large portion of the moisture in the air has built up as frost on the elongated straight runs 22 of the first or lower section 27.

The refrigerant flows from the inlet tube 23 into the uppermost of the elongated straight runs 22 of the right row of the first section 27. The refrigerant then flows downwardly through the elongated straight runs 22 and the return bent ends 24 of the right hand row of the first section 27 until the refrigerant reaches the lowermost of the elongated straight runs 22 in the right row of the first section 27. The refrigerant flows from the lowermost of the elongated straight runs 22 in the right hand row of the first section 27 through one of the return bent ends 24 to the lowermost of the elongated straight runs 22 in the left hand row of the first section 27 and then flows upwardly through the remainder of the elongated straight runs 22 and the return bent ends 24 of the left hand row of the first section 27.

The refrigerant flows from the uppermost of the elongated straight runs 22 of the left hand row of the first section 27 through on of the return bent ends 24 to the lowermost of the elongated straight runs 22 in the left hand row of the second section 28. The refrigerant then flows upwardly through the remainder of the elongated straight runs 22 and the connecting return bent ends 24 in the left hand row of the second section 28 until the refrigerant reaches the uppermost of the elongated straight runs 22 in the left hand row of the second section 28.

The uppermost of the elongated straight runs 22 in the left hand row of the second section 28 is connected by one of the return bent ends 24 to the uppermost of the elongated straight runs 22 in the middle row of the second section 28. The refrigerant then flows downwardly from the uppermost of the elongated straight runs 22 in the middle row of the second section 28 through the elongated straight runs 22 and the return bent ends 24 in the middle row of the second section 28 until the refrigerant reaches the lowermost of the elongated straight run 22 in the middle row of the second section 28.

Then, the refrigerant flows from the lowermost of the elongated straight runs 22 in the middle row of the second section 28 through on of the return bent ends 24 to the lowermost of the elongated straight runs 22 in the right hand row of the second section 28. The refrigerant then flows upwardly through the elongated straight runs 22 and the return bent ends 24 in the right hand row of the second section 28. The uppermost of the elongated straight runs 22 in the right row of the second section 28 is connected to the outlet tube 23' to enable the refrigerant to be removed from the evaporator 15.

The refrigerant flow scheme is presently preferred and should provide optimal performance, due to the pressure drop through the evaporator 15. However, it will be understood that other refrigerant flow schemes may be incorporated. For example, the refrigerant flow path could be the reverse of that described, that is with the refrigerant entering through the tube 23' and exiting through the tube 23. With either of the two flow paths described, the evaporator 15 provides for an "upflow" of refrigerant in the final passes. This upflow of the refrigerant is to minimize slugging of liquid refrigerant at the inlet of the compressor.

The close positioning of the elongated straight runs 22 and overlapping of the fins 25 causes the air flowing over the upper section 28 to flow through a myriad of labyrinth passages formed by the fins 25 and the elongated straight runs 22. This assures excellent heat exchange between the refrigerant flowing through the tube 23 and the air flowing over and around the upper section 28. Any significant frost build-up on the upper section 28 will close off various areas of the labyrinth passages and reduce the heat exchange efficiency of the upper section 28. However, since most of the moisture has condensed out of the air as frost on the lower section 27, frost builds up on the upper section 28 rather slowly, enabling lengthened periods of effective refrigeration operation between successive defrost operations.

As the frost accumulates on the evaporator 15, it is removed periodically from the surfaces of the evaporator 15 by energizing a heater 29 (see FIG. 1), which is disposed at the bottom of the evaporator 15. One suitable example of the heater 29 is the defrost heater shown and described in U.S. Pat. No. 5,042,267 to Beers et al.

With the first section 27 (see FIG. 2) having the elongated straight runs 22 spaced from each other with each row of the elongated straight runs 22 moving inwardly in an upward direction, the first or lower section 27 has an "A" shape. The second or upper section 28 of the elongated straight runs 22 may be deemed to be a close pack section. Thus, the evaporator 15 may be considered an "A stack" evaporator since the close pack second section 28 is stacked on the A-shaped first section 27.

Figure 4:
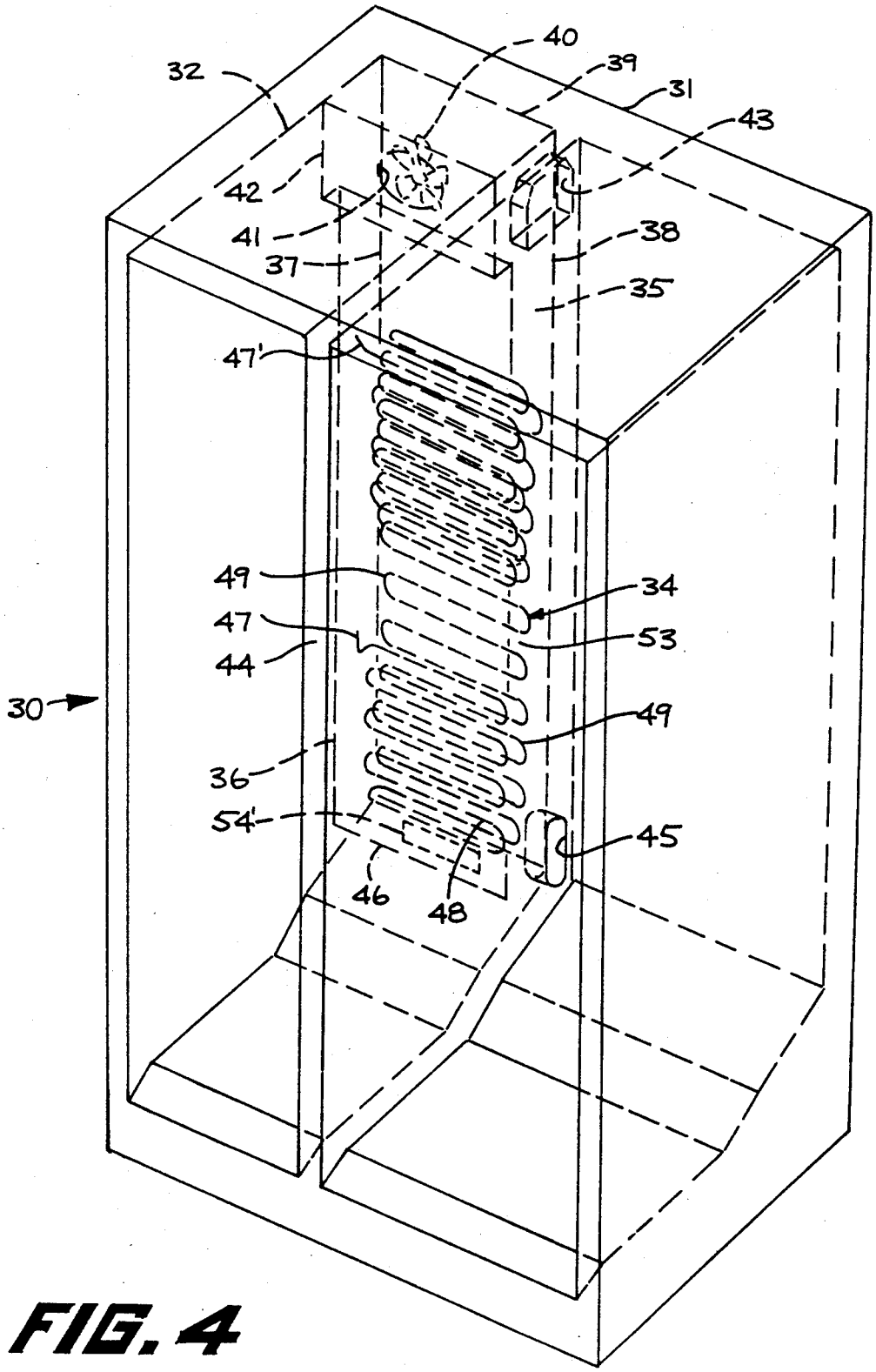
FIG. 4 is a perspective view of a side by side refrigerator having a spine fin evaporator incorporating one embodiment of the present invention and with the refrigerator doors removed.

Referring to FIG. 4, there is shown a side by side refrigerator 30 including an outer cabinet 31 containing a freezer compartment 32 and a fresh food compartment 33 arranged in a side by side relation. The freezer compartment 32 is maintained at below freezing temperatures and the fresh food compartment 33 is maintained at above freezing-food preserving temperatures by circulating air over a spine fin evaporator 34.

The evaporator 34 is disposed within a vertically extending evaporator chamber 35. The evaporator chamber 35 is formed by a vertically extending front wall 36, vertically extending side walls 37 and 38, and an inner rear liner 39 of the refrigerator 30.

A motor driven fan 40 is positioned in the upper portion of the evaporator chamber 35 and discharges cooling air through an opening 41 in an upper offset portion 42 of the front wall 36 into the freezer compartment 32. The fan 40 also discharges cooling air through an opening 43 in a dividing wall 44, which separates the freezer compartment 32 and the fresh food compartment 33, into the fresh food compartment 33.

The fan 40 draws air from the fresh food compartment 33 through an opening 45 in the dividing wall 44 into the lower portion of the evaporator chamber 35. The fan 40 also draws air from the freezer compartment 32 through an opening 46 in the bottom of the front wall 36 of the evaporator chamber 35. Thus, the return air flows upwardly through the evaporator 34 from its lower end and flows substantially perpendicular to the sides of the evaporator 34.

The cooling air supplied from the fan 40 through the openings 41 and 43 is divided so that the freezer compartment 32 is maintained at below freezing temperatures and the fresh food compartment 33 is maintained at above freezing but food preserving temperatures. This division of the cooling air is well known in the art.

The serpentine evaporator 34 has refrigerant supplied from a condenser (not shown) and an expansion device (not shown) as is well known in the art through an inlet tube 47 (see FIG. 5) connected to one end of the first of a plurality of elongated straight runs 48, which extend substantially perpendicular to the air flow through the evaporator chamber 35 (see FIG. 4). Except for the elongated straight run 48 (see FIG. 5) connected to the inlet tube 47 and the elongated straight run 48 connected to an outlet tube 47' through which refrigerant flows from the evaporator 34 to a compressor (not shown) as is well known in the art, each of the elongated straight runs 48 is connected to each of the serially adjacent elongated straight runs 48 by return bent ends 49 in the same manner as previously described for the elongated straight runs 22 (see FIG. 3) and the return bent ends 24 of the evaporator 15. The elongated straight runs 48 (see FIG. 5) and the return bent ends 49 form the evaporator 34 as an elongated tube having a serpentine arrangement.

The return bent ends 49 are preferably mounted in end channels (not shown) in the same manner as the return bent ends 24 (see FIG. 2) of the evaporator 15. Each of the elongated straight runs 48 (see FIG. 5) and each of the return bent ends 49 of the evaporator 34 has spine fins 50 wrapped therearound in the same manner as the spine fins 25 (see FIG. 2) are wrapped around the elongated straight runs 22 and the return bent ends 24 of the evaporator 15.

The evaporator 34 (see FIG. 5) has a first or lower section 51 having a converging central passage formed by two rows of the elongated straight runs 48 in the same manner as the first or lower section 27 (see FIG. 2) of the elongated straight runs 22 of the evaporator 15. A second or upper section 52 (see FIG. 5) of the elongated straight runs 48 has three substantially parallel rows of the elongated straight runs 48 arranged in a tightly or closely packed relation in the same manner as the second or upper section 28 (see FIG. 2) of the evaporator 15.

The evaporator 34 (see FIG. 5) has refrigerant flow thereto through the inlet tube 47 into the uppermost of the elongated straight runs 48 in the left hand row of the first section 51. The refrigerant flows downwardly through the remainder of the elongated straight runs 48 and the return bent ends 49 in the left hand row of the first section 51 to the lowermost of the elongated straight runs 48 in the left hand row of the first section 51.

Then, the refrigerant flows from the lowermost of the elongated straight runs 48 in the left hand row of the first section 51 through one of the return bent ends 49 to the lowermost of the elongated straight runs 48 in the right hand row of the lower section 51. The refrigerant flows upwardly through the elongated straight runs 48 and the return bent ends 49 of the right hand row of the first section 51 until the refrigerant reaches the uppermost of the elongated straight runs 48 in the right hand row of the first section 51.

Figure 5:
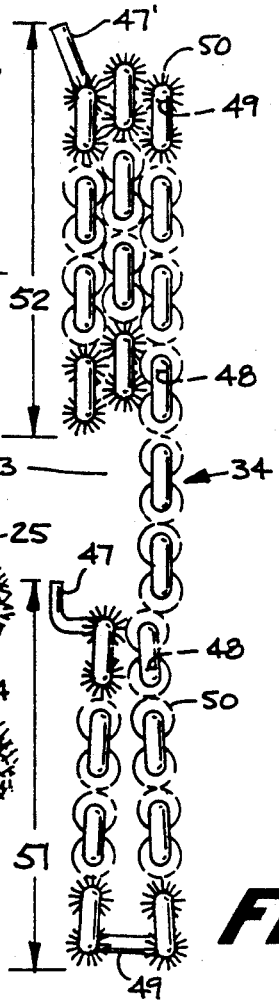
FIG. 5 is an end elevational view of one embodiment of the spine fin evaporator of the present invention used in the side by side refrigerator of FIG. 4.

From the uppermost of the elongated straight runs 48 in the right hand row of the lower section 51, refrigerant flows through one of the return bent ends 49, which cannot be seen in FIG. 5 because of the fins 50, to the lowermost of the elongated straight runs 48 in the right hand row of the second section 52. The refrigerant flows upwardly through the elongated straight runs 48 and the return bent ends 49 in the right hand row of the second section 52 until the refrigerant reaches the uppermost of the elongated straight runs 48 in the right hand row of the second section 52.

The refrigerant flows from the uppermost of the elongated straight runs 48 in the right hand row of the second section 52 through one of the return bent ends 49, which cannot be seen in FIG. 5 because it is blocked by the fins 50, to the uppermost of the elongated straight runs 48 in the middle row of the second section 52. Refrigerant flows downwardly from the uppermost of the elongated straight runs 48 in the middle row of the second section 52 through the elongated straight runs 48 and the return bent ends 49 in the middle row of the second section 52 until the refrigerant reaches the lowermost of the elongated sraight runs 48 in the middle row of the second section 52.

Refrigerant flows from the lowermost of the elongated straight runs 48 in the middle row of the second section 52 through one of the return bent ends 49, which cannot be seen in FIG. 5 because of the fins 50, to the lowermost of the elongated straight runs 48 in the left hand row of the second section 52. Refrigerant flows upwardly from the lowermost of the elongated straight runs 48 in the left hand row of the second section 52 through the elongated straight runs 48 and the return bent ends 49 in the left hand row of the second section 52 to the uppermost of the elongated straight runs 48 in the left hand row of the second section 52. The refrigerant exits from the uppermost of the elongated straight runs 48 in the left hand row of the second section 52 through the outlet tube 47'. As discussed earlier with regard to the embodiment of FIGS. 1 and 2, refrigerant flow schemes other than that described may be employed with this embodiment.

A portion of the second section 52 (see FIG. 5) of the elongated straight runs 48 is spaced vertically from the first section 51 to provide a space 53 therebetween for a defrost heater 54, which is preferably the same as the heater 29 (see FIG. 1) of the evaporator 15. (The heater 54 has been omitted from FIG. 4 for the sake of simplicity.) It should be understood that another heater 54' (see FIG. 4) could be disposed beneath the lower end of the evaporator 34 in the same manner as the heater 29 (see FIG. 1) of the evaporator 15.

Figure 6:
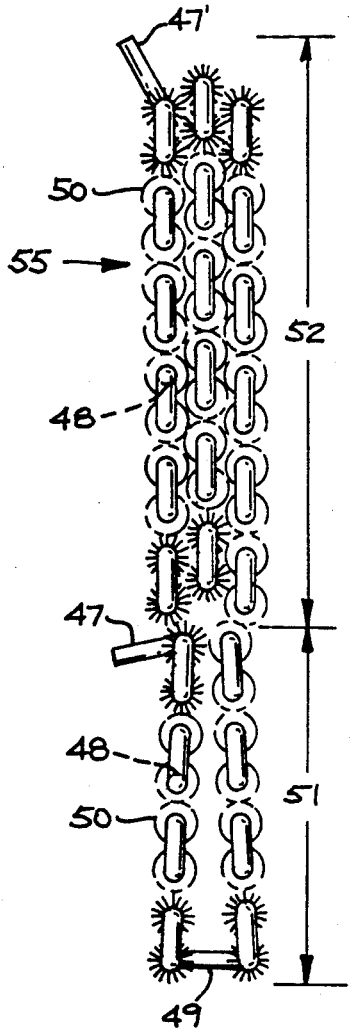
FIG. 6 is an end elevational view of another embodiment of the evaporator of the present invention used in the side by side refrigerator of FIG. 4.

If it is determined that the space 53 (see FIG. 5) is not needed by the evaporator 34, an evaporator 55 (see FIG. 6) may be employed in the evaporator chamber 35 (see FIG. 4). The evaporator 55 (see FIG. 6) is arranged the same as the evaporator 34 (see FIG. 5) except that it does not have the space 53. Thus, the evaporator 55 (see FIG. 6) has the first or lower section 51 of the elongated straight runs 48 and the entire or upper section 52 of the elongated straight runs 48 adjacent each other.

It should be understood that the evaporator 55 would have only the defrost heater beneath the lower end of the evaporator 55. This would be the same general arrangement as the heater 29 of the evaporator 15.

The length of each of the first or lower section 27 (see FIG. 2) and the second or upper section 28 of the evaporator 15 and the first or lower section 51 (see FIG. 5) and the second or upper section 52 of the evaporator 34 or the evaporator 55 (see FIG. 6) can be adjusted to provide a desired frost tolerance. That is, either of the first or second section can be lengthened or shortened relative to the other as necessary to insure that there is very little frost ever gathered on the second or upper section 28 (see FIG. 2) of the evaporator 15 or the second or upper section 52 (see FIG. 5) of the evaporator 34 or the evaporator 55 (see FIG. 6).

While the return bent ends 24 (see FIG. 2) of the evaporator 15 have the spine fins 25 wrapped therearound and the return bent ends 48 (see FIG. 5) of the evaporators 34 and 55 (see FIG. 6) have the spine fins 50 wrapped therearound, it should be understood that many of the spine fins 25 (see FIG. 2) on the return bent ends 24 and the spine fins 50 (see FIG. 5) on the return bent ends 48 may become bent or compressed during formation of the evaporator. This does not materially affect operation of the evaporator.

For ease of illustrating the configurations of the illustrative evaporators, the spine fin material has been schematically illustrated extending along only small portions of the evaporator tube straight runs and return bent ends. In addition, in FIGS. 1, 2, 5 and 6 the spine fin material is represented at times by a dashed circle spaced around the outside of the evaporator tube and no spine fin material is shown at the return bent end portions to better illustrate their configurations. It will be understood that, in the preferred embodiment, a strip of spine fin material is continuously wrapped around the entire length of the evaporator tube.

An advantage of this invention is that a large amount of surface area of a spine fin evaporator is provided in a relatively small volume. Another advantage of this invention is that it enables an evaporator to have a close pack of elongated straight runs without having a relatively large amount of frost build up thereon.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A refrigerator including:

an evaporator chamber;

means for causing air to flow through said evaporator chamber in a predetermined direction;

a refrigerant evaporator disposed within said evaporator chamber;

said refrigerant evaporator including:

an elongated tube having elongated straight runs and return bent ends joining said elongated straight runs in a serpentine arrangement;

a plurality of heat exchange fins disposed along at least each of said elongated straight runs, said fins projecting outwardly therefrom;

said elongated straight runs being arranged in said evaporator chamber in a plurality of passes extending substantially perpendicular to the direction of air flow through said evaporator chamber;

said refrigerant evaporator having a first section of said elongated straight runs initially exposed to air flow through said evaporator chamber;

said elongated straight runs of said first section being arranged in two rows extending generally in the direction of air flow through said first section in which said fins on said elongated straight runs in one of said rows are spaced from said fins of said elongated straight runs in the other of said rows to form an air passage therebetween for air flowing through said evaporator chamber;

and said refrigerant evaporator having a second section of said elongated straight runs connected to said first section of said elongated straight runs and exposed to air flow after it has passed through said first section of said elongated straight runs, said elongated straight runs of said second section being arranged in a plurality of rows extending generally in the direction of air flow through said evaporator chamber, said rows being so positioned relative to one another that said fins on said elongated straight runs in each of said rows overlap said fins on said elongated straight runs in each of said rows adjacent thereto.

2. The refrigerator according to claim 1 in which said second section of said elongated straight runs has three of said rows of said elongated straight runs.

3. The refrigerator according to claim 2 including: said refrigerant evaporator having a space between said first section of said elongated straight runs and said second section of said elongated straight runs in the direction of air flow; and defrost heating means disposed in said space to aid in defrosting said refrigerant evaporator.

4. The refrigerator according to claim 3 in which said elongated straight runs of said first section are arranged in an A shape when viewed from the end of said refrigerant evaporator.

5. The refrigerator according to claim 2 in which said elongated straight runs of said first section are arranged in an A shape when viewed from the end of said refrigerant evaporator.

6. The refrigerator according to claim 1 including: said refrigerant evavporator having a space between said first section of said elongated straight runs and said second section of said elongated straight runs in the direction of air flow; and defrost heating means disposed in said space to aid in defrosting said refrigerant evaporator.

7. The refrigerator according to claim 1 in which said elongated straight runs of said first section are arranged in an A shape when viewed from the end of said refrigerant evaporator.

8. The refrigerator according to claim 1 in which the spacing between said fins of corresponding elongated straight runs in each of said two rows of said first section is greatest where air enters said first section and decreases axially of said first section.

9. A refrigerator including:

substantially vertically extending walls defining an evaporator chamber;

fan means for causing air to flow generally upwardly through said evaporator chamber;

a refrigerant evaporator disposed within said evaporator chamber;

said refrigerant evaporator including:

an elongated tube having elongated straight runs and return bent ends joining said elongated straight runs in a serpentine arrangement;

and a plurality of heat exchange spine fins disposed along at least each of said elongated straight runs, said fins projecting outwardly therefrom;

said elongated straight runs being arranged in said evaporator chamber in a plurality of passes extending substantially vertical and lying closely adjacent to corresponding ones of said vertically extending walls;

said refrigerant evaporator having a first section of said elongated straight runs at its lower end;

said elongated straight runs of said first section being arranged in two substantially vertical rows in which said fins on said elongated straight runs in one of said rows are spaced from said fins of said elongated straight runs in the other of said rows to form an air passage therebetween for air flowing through said evaporator chamber;

and said refrigerant evaporator having a second section of said elongated straight runs connected to said first section of said elongated straight runs and disposed above said first section of said elongated straight runs, said elongated straight runs of said second section being arranged in a plurality of substantially vertical rows in which said fins on said elongated straight runs in each of said rows overlap said fins on said elongated straight runs in each of said rows adjacent thereto so that frost build up between said elongated straight runs of said second section is significantly lower than frost build up between said elongated straight runs of said first section.

10. The refrigerator according to claim 9 in which said second section of said elongated straight runs has three of said rows of said elongated straight runs.

11. The refrigerator according to claim 9 including:

said refrigerant evaporator having a space between the top of said first section of said elongated straight runs and the bottom of said second section of said elongated straight runs;

and defrost heating means disposed in said space to aid in defrosting said refrigerant evaporator.

12. The refrigerator according to claim 9 in which said elongated straight runs of said first section are arranged in an A shape when viewed from the end of said refrigerant evaporator.

13. The refrigerator according to claim 9, in which the spacing between said two substantially vertical rows of elongated straight runs in said first evaporator section is greatest at the lower end thereof and decreases in the vertical direction.

14. The refrigerator according to claim 10 including:

means for introducing refrigerant into said refrigerant evaporator through the uppermost of said elongated straight runs in one of said two rows of said first section, said elongated straight runs in said first section being serially connected for flow of the refrigerant downwardly through said one row of said elongated straight runs of said first section and then upwardly through the other of said two rows of said elongated straight runs of said first section;

said other row of said elongated straight runs of said first section being connected to one of the outer rows of said three rows of said elongated straight runs of said second section for flow of refrigerant from said first section to said second section, said elongated straight runs of said second section being serially connected for flow of refrigerant upwardly through said one outer row, then downwardly through the middle of said three rows of said second section, and then upwardly through the other of the outer rows of said three rows of said second section;

and means for removing refrigerant from the uppermost of said elongated straight runs of said other outer row of said elongated straight runs of said second section.

15. The refrigerator according to claim 9 including:

means for introducing refrigerant into said refrigerant evaporator through the uppermost of said elongated straight runs in one of said two rows of said first section, said elongated straight runs of said first section being connected for serial flow of the refrigerant downwardly through said one row of said elongated straight runs of said first section and then upwardly through the other of said two rows of said elongated straight runs of said first section;

said other row of said elongated straight runs of said first section being connected to an outer row of said plurality of rows of said elongated straight runs of said second section for flow of refrigerant from said first section to said second section, said elongated straight runs of said second section being serially connected for flow of refrigerant upwardly through said outer row and then in opposite directions through each of the remainder of said plurality of rows of said elongated straight runs of said second section;

and means for removing refrigerant from the last of said plurality of rows of said elongated straight runs of said second section through which the refrigerant flows.

* * * * *